US006944900B2

(12) United States Patent
Van Patten

(10) Patent No.: US 6,944,900 B2
(45) **Date of Patent: *Sep. 20, 2005**

(54) QUILTED MATTRESS COVER WITH INVERTED SEAM

(75) Inventor: Neal Charles Van Patten, Northampton, MA (US)

(73) Assignee: Dreamwell Ltd., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/894,971

(22) Filed: Jul. 19, 2004

(65) Prior Publication Data

US 2004/0261187 A1 Dec. 30, 2004

Related U.S. Application Data

(63) Continuation of application No. 10/274,455, filed on Oct. 17, 2002, now Pat. No. 6,804,849.

(51) Int. Cl.[7] ..... A47C 17/00; B68G 7/10

(52) U.S. Cl. ..... 5/737; 5/739; 29/91; 29/91.1; 29/91.6

(58) Field of Search ..... 5/717, 721, 737, 5/739, 402, 408, 409, 690, 696; 29/91, 91.1, 91.6

(56) References Cited

U.S. PATENT DOCUMENTS

| | | | | |
|---|---|---|---|---|
| 1,328,248 A | * | 1/1920 | Hawn | 112/418 |
| 1,596,209 A | | 8/1926 | Mulkey | |
| 2,201,361 A | * | 5/1940 | Bennett | 5/739 |
| 3,778,852 A | | 12/1973 | Penn et al. | |
| 4,606,087 A | | 8/1986 | Alivizatos | |
| 4,689,844 A | | 9/1987 | Alivizatos | |
| 5,475,881 A | * | 12/1995 | Higgins et al. | 5/737 |
| 5,896,605 A | * | 4/1999 | Branman | 5/716 |
| 6,088,858 A | * | 7/2000 | Juster et al. | 5/737 |
| 6,574,815 B2 | * | 6/2003 | Freeman et al. | 5/716 |
| 6,804,849 B2 | * | 10/2004 | Van Patten | 5/737 |

OTHER PUBLICATIONS

"Characteristics of the CR Healthcare Mattresses" (www-.westol.com/crfoam/mattchar.html) printed Oct. 8, 2002.

"Beds", Southwest Contract Inc.'s On–Line Catalog, (http://www.southwestcontract.com/files/PDF/Beds.pdf) printed Oct. 8, 2002.

"Mattresses Cotton Core and Foam", Minncor Industries, (www.minncor.com/correctionalproducts/detention/detentionmattresses.htm) printed Oct. 8, 2002.

"Coleman Expands Full Line of Tents, Shelter", (http://totalescape.com/tripez/camp/articles/tents.html) printed Oct. 8, 2002.

* cited by examiner

*Primary Examiner*—Michael Trettel
(74) *Attorney, Agent, or Firm*—Fish & Neave IP Group; Ropes & Gray LLP

(57) ABSTRACT

A mattress having an inverted top panel/border seam, with an optional appended decorative rope welting on the border is described. An inverted seam secures the top panel to the border portion of a mattress cover to eliminate bumps and creases found in conventional welted top seam. Manufacturing costs may be reduced by eliminating the need for an expensive table-mounted tape edge closure machine and/or skilled operators, since the inverted seam may be flay sewn with a conventional sewing machine or even hand-stitched. Alternatively, a conventional tape edge machine can be used with less-skilled labor and or reduced tape/welting material, as all of the stitches and welting are hidden inside the mattress by the inverted seam.

15 Claims, 8 Drawing Sheets

QUILTED MATTRESS COVER WITH INVERTED SEAM

This application is a continuation of U.S. patent application Ser. No. 10/274,455, filed Oct. 17, 2002, and now U.S. Pat. No. 6,804,849 issued Oct. 19, 2004.

BACKGROUND OF THE INVENTION

1. Field of the Invention

The present invention related to mattresses, specifically to quilted mattress covers and methods of making same.

2. Background of the Invention

Mattresses with quilted mattress covers are well-known in the art. For example, U.S. Pat. No. 5,896,605 describes a conventional mattress construction with an inner coil spring unit surrounded on the top and bottom by padding which provides a barrier and cushion against the metal springs. An additional wire grid is further provided as a barrier between the padding and the spring unit. The unit is then padded on its top and bottom by layers of foam, cotton, and other materials. The typical outer construction of a mattress includes a top and bottom cover panel and a border which surrounds the four sides or perimeter of the spring unit. The panels and border are usually quilted fabric available in a variety of colors and print patterns, thus providing the initial aesthetic appeal to the customer.

A flange formed by a strip of strong fabric is attached to the boundaries or peripheries of the top and bottom panels prior to the final assembly of the mattress. The top and bottom flanges extend over the side edges of the spring unit and are anchored to the springs using metal rings, commonly referred to as "hog rings." The flanges fix the padded layers in place on the top and bottom of the spring unit, so that during prolonged use the various layers are not dislodged. The flanges also serve to resist the tensile forces around the perimeter of the bed resulting from a body resting on top of the mattress.

A specialized tape edge machine, mounted on a special table, is used to attach the border to the top and bottom covers after the flanges of the covers have been attached to the spring unit. Wads of cotton material are often inserted just prior to the covers' attachment in order to round and pad the corners of the mattress. Also, stiffening members may be affixed to upper and lower border wires (when such wires or rods are used) along the mattress sides prior to final assembly, for people who sit on the edge of the bed and require extra support therein.

In the final assembly of the mattress, a decorative tape or welting is folded over the outside edges of the panel, flange, and border materials by an operator. The operator must manually position the tape over the raw edges while walking backward, as the machine moves around the mattress and stitches the tape to form a welt around the finished side of the mattress perimeter. This is done for the top panel attachment to the border, and also for the bottom panel attachment to the border. The tape edge machine and its required components are quite costly, and a highly skilled operator is required to produce quality mattresses.

The components of a conventional mattress constructed as above are illustrated in FIG. 1. Layers of padding are placed between the cover panels 12, 14 and a coil spring unit 38, with the layers repeated in order on the unit's two finished (sleeping) surfaces. The mattress typically includes a foam pad 40, a cotton pad 42, a padding 44, and a grid 46 which is placed closest to springs 48 of the unit 38. Flanges 52 and 58 are secured to coil springs 48 (one shown) by hog rings 54.

A border 16 is attached to panels 12, 14 by welting 35 at seam 34 (on the top corner) and welting 35 at seam 36 (on the bottom corner) with its finished side facing outward. This attachment is typically made by stitching through the welting, border 16, flange 52 or 58, and cover panel 12 or 14 on the finished (customer-facing) side of the seam.

Padding 44 adds a cushioning layer and prevents the foam and cotton pads 40, 42 from becoming lodged in, or pushed through, the grid 46 and/or the springs 48.

The presence of welting 35 on seam 34 (i.e., on the top corner edge of the mattress) has often been cited as a cause of some discomfort by users. It is also known to trap dirt and crumbs. More significantly, the need to use a specialized tape edge machine, mounted on a special table, with the concomitant requirement for a specially skilled operator, increases production costs.

It would therefore be desirable to provide a mattress having a mattress cover without an outside welt, and a method of seaming such mattress cover without the need for a skilled operator and specialized equipment for assembly, such as a tape edge machine and/or a special table.

SUMMARY OF THE INVENTION

A mattress having an inverted top panel/border seam, with optional appended decorative rope welting on the border is described. The invention uses an inverted seam to sew the top panel (i.e., the top sleeping surface) to the border or side portion of a mattress cover in a way that eliminates the bumps and creases of the conventional welted top seam. Manufacturing costs may be reduced by eliminating the need for an expensive table-mounted tape edge closure machine and specially-skilled operator as the present invention may be flay sewn with a conventional sewing machine or even hand-stitched. Alternatively, a conventional tape edge machine can be used with less-skilled labor and or reduced tape/welting material, as all of the stitches and welting are hidden inside the mattress by the inverted seam.

According to one aspect of the invention, a mattress covering with an inverted seam includes a top panel having a perimeter edge and a finished side, and a border having a perimeter edge and a finished side. The border is attached to the panel, with the finished side of the panel facing the finished side of the border, along the perimeter edge of at least one of the panel and the border to form the inverted seam.

According to another aspect of the invention, a method of forming a mattress covering having an inverted seam includes arranging a panel on a mattress, the panel having an unfinished side facing the mattress, a finished side opposite the finished side and forming a sleeping surface, and a perimeter; and positioning a border having a perimeter, a free perimeter and a finished side in such a way that the perimeter of the border is positioned proximate to the perimeter of the panel and the finished side of the panel faces the finished side of the border, The border is secured to the panel along the perimeter edge of at least one of the panel and the border to form the inverted seam.

According to yet another aspect of the invention, a mattress includes a mattress core; and a mattress cover disposed on the mattress core and having at least a top cover panel and a border. The border is attached to said top cover panel by an inverted seam that is obscured from view.

Embodiments of the invention may include one or more of the following features. The inverted seam does not require special equipment and can be sewn flat on a standard sewing machine. The inverted seam can include a tape encompassing said attached border and panel on a side opposite the finished side of the border and panel, wherein tape is obscured from view when viewed from the outside of the mattress, i.e., said finished sides of said panel and said border. The mattress cover may also include a decorative welting, such as a decorative rope, attached to said finished side of said panel and said border proximate to said inverted seam.

The inverted seam can be formed by sewing, flat-sewing, gluing, heat-setting and stapling. To strengthen the seam, the positioned border and panel can be folded over so that the folded unfinished side of the panel faces the unfinished side of the panel disposed on the top surface of the mattress core. In addition, a tape so can be applied to encompass the folded border and panel and the tape, the border and the panel can be sewn along the perimeter edges to form the inverted seam.

After the inverted seam is formed, the border can be folded over the inverted seam and a side of the mattress, so that the finished side of the border faces outwardly, i.e., away from the mattress, thereby obscuring the inverted seam from view from said finished sides of said panel and said border. A second panel can be secured to the free perimeter edge of the border so as to enclose the mattress between the panel, the second panel and the border.

The mattress core can be an open spring unit, or can include a tray, such as a tray made of rubber or plastic foam, which encompasses the spring. The latter arrangements obviates the need for padding between the border and the springs.

BRIEF DESCRIPTION OF THE DRAWINGS

The present disclosure may be better understood and its numerous features and advantages made apparent to those skilled in the art by referencing the accompanying drawings.

The use of the same reference symbols in different drawings indicates similar or identical items.

DETAILED DESCRIPTION OF CERTAIN ILLUSTRATED EMBODIMENTS

Figure 2:
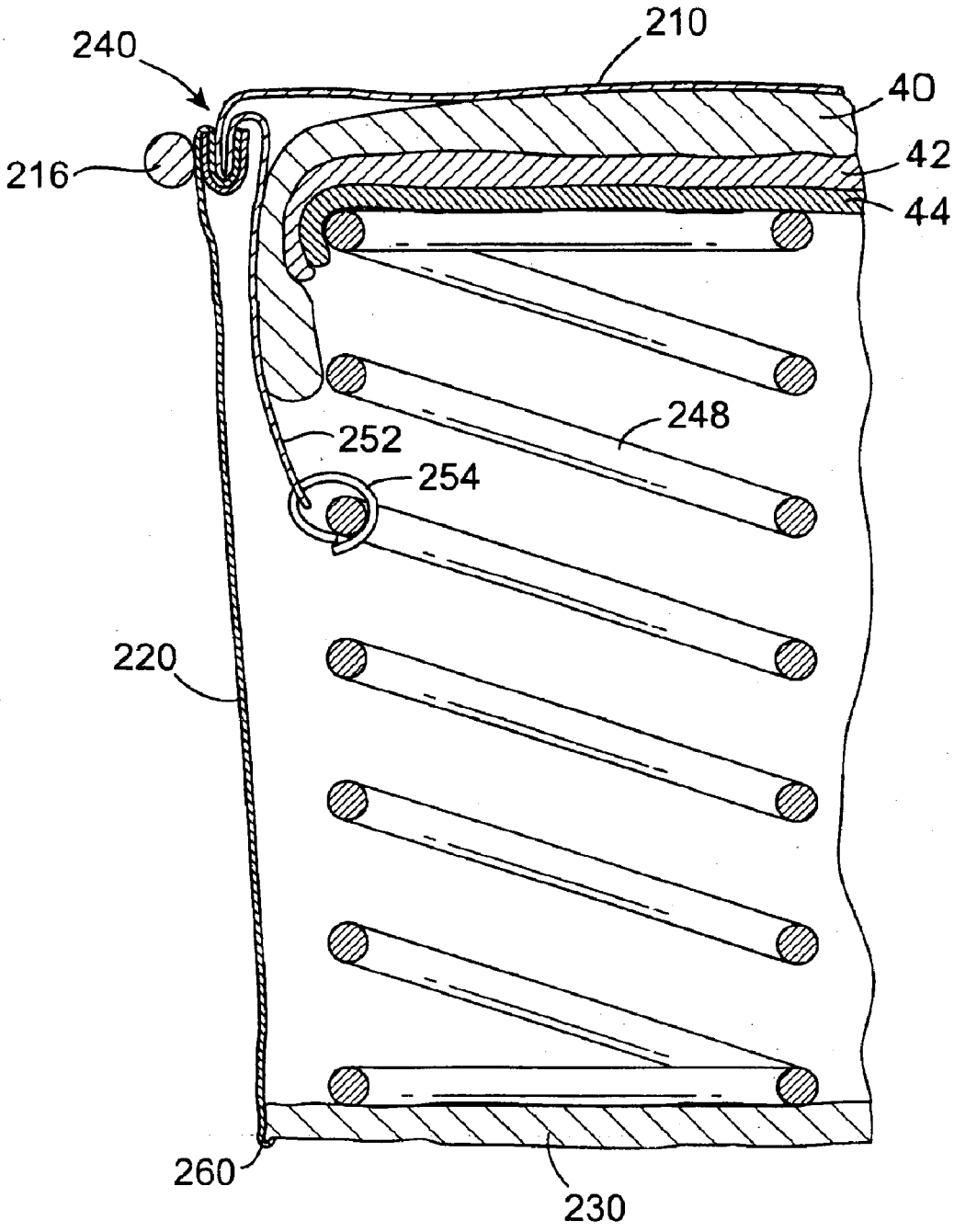
FIG. 2 is a schematic section of a mattress with a mattress cover with an inverted seam according to one embodiment of the invention.

FIG. 2 illustrates an exemplary mattress with a coil spring unit 48 (only one exemplary spring 48 is shown) and a mattress cover having an inverted seam construction according to one embodiment of the present invention. The mattress can include conventional padding layers 40, 42, 44, onto which a top panel 210 which can be quilted and forms the sleeping surface is placed. The mattress cover also includes a border 220 along a lateral side of the mattress. The border 220 and the top panel 210 are connected with each other around a perimeter of the mattress by a seam 240 which is inverted, i.e. the seam is stitches are disposed on the side of the seam facing the interior of the mattress. The seam 240 is preferably arranged along the perimeter proximate to the top side of the mattress, i.e., the side a user may prefer as the sleeping surface. A second seam 260 can be provided around the perimeter proximate to the bottom panel 230 of the mattress which, in particular for a one-sided mattress, may not require a high-quality finish and may therefore be attached to the bottom panel 230 in a conventional manner.

Although only a top flange 252 is shown as being attached to top seam 240, it will be understood that flanges can also be provided as needed at the bottom seam 260. Padding 40, 42, 44 need not be separate layers, but can be implemented as a single layer using materials commonly employed in the manufacture of mattresses, such as rubber or plastic foam, drilling, etc.

Figure 3:
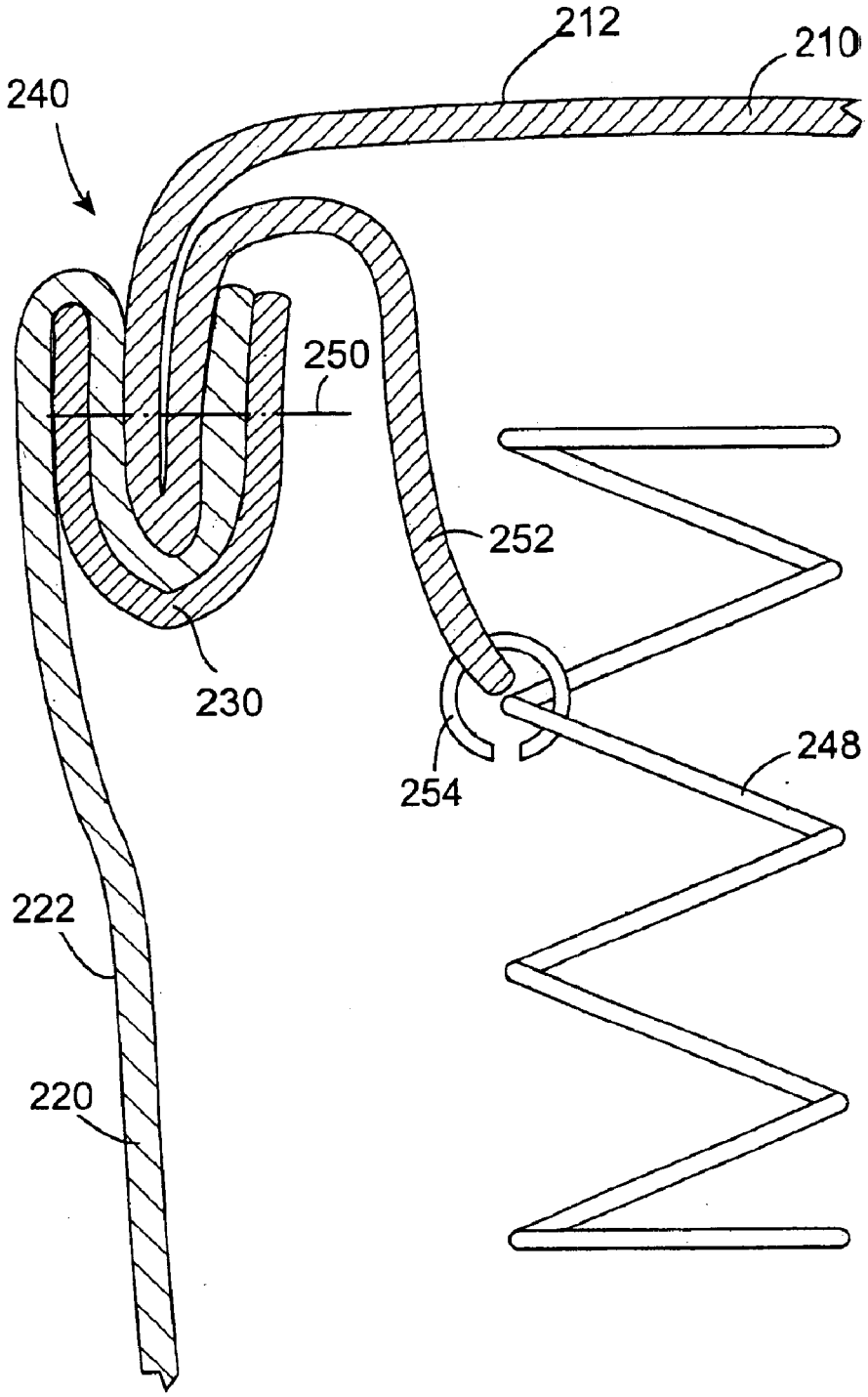
FIG. 3 shows the inverted seam of FIG. 2 in greater detail.

FIG. 3 shows the inverted seam 240 of FIG. 2 in greater detail in an assembled state, i.e., with the border 222 folded over the side of the mattress after the inverted seam 240 has been completed. The inverted seam 240 joins the top panel 210 with the border 220, typically by stitching 250, as described below. The top panel 210 is shown as including an integrally formed flange 252 that can be anchored to spring unit 248, for example, with a hog ring 254 or other fasteners known in the art to limit movement of the top panel 210 relative to the spring construction. Other embodiments of the inverted seam will be described below with reference to FIGS. 4A–4D. To reinforce the inverted seam 240, a welting tape 230 can be wrapped around the two fabric layers, the top panel 210 and the border 220.

Figure 4A:
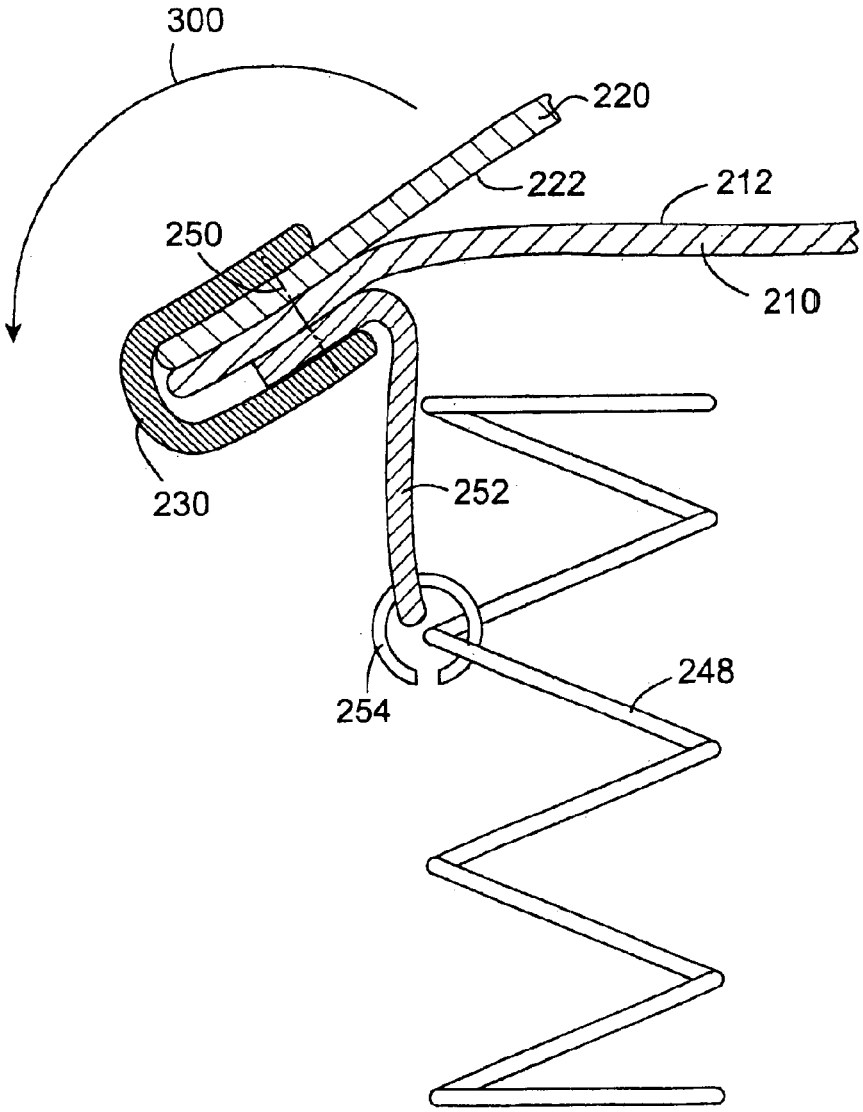
FIGS. 4A–D show various embodiments of the inverted seam of FIG. 2.

An exemplary assembly process for the mattress cover with the inverted seam 240 and for a mattress having such mattress cover will now be described. FIGS. 4A–4D schematically depict various embodiments of the inverted seam 240 of the mattress cover, with the assembly process applying to all the depicted embodiments. The mattress can be received at a stitching station (not shown) at least partially preassembled, with already placed on the inner coil spring unit and optional flange(s) 252 attached to springs 248. The finished side 212 (sleeping surface) of the top panel 210 faces outwardly. The border 220 is then placed on the mattress surface 212, with the finished side 222 of the border 220 facing the finished side 212 of the top panel 210. The border 220 can be temporarily held in place, for example, by clamping near the corners of the inner coil spring unit or by other positioning and/or holding means, so that its top edge is roughly aligned with the perimeter of panel 210. The seam can then be stitched flat by an operator who can make final positioning adjustments during stitching. The seam depicted in FIG. 4A is shown as a single seam, whereby the stitches 250 penetrate once through the panel 210 and the border 220 and, optionally, twice through the welting tape 230. As mentioned above with reference to FIG. 3, the flange 252 can be a separate strap or form an integral part with either the top panel 210 or the border 220.

Figure 4B:
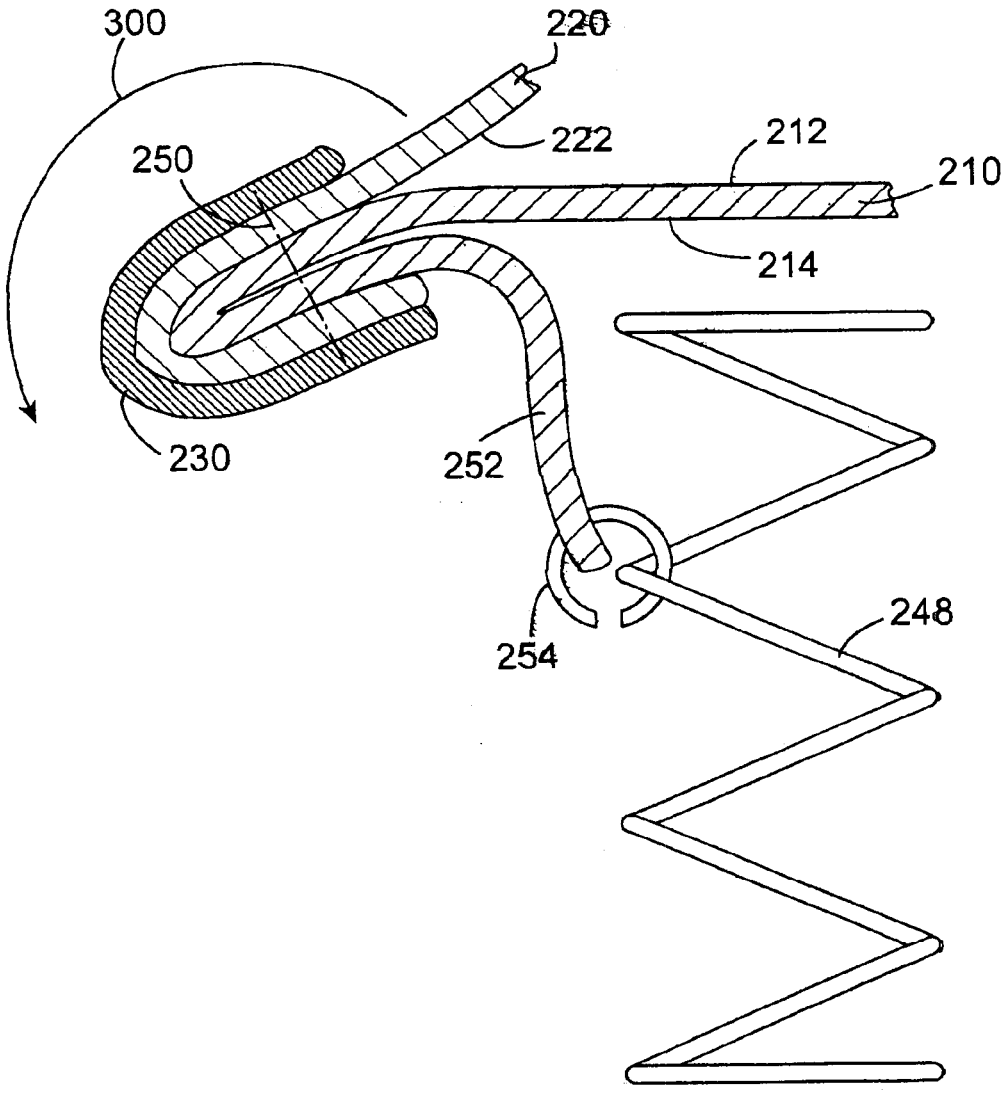
Figure 4C:
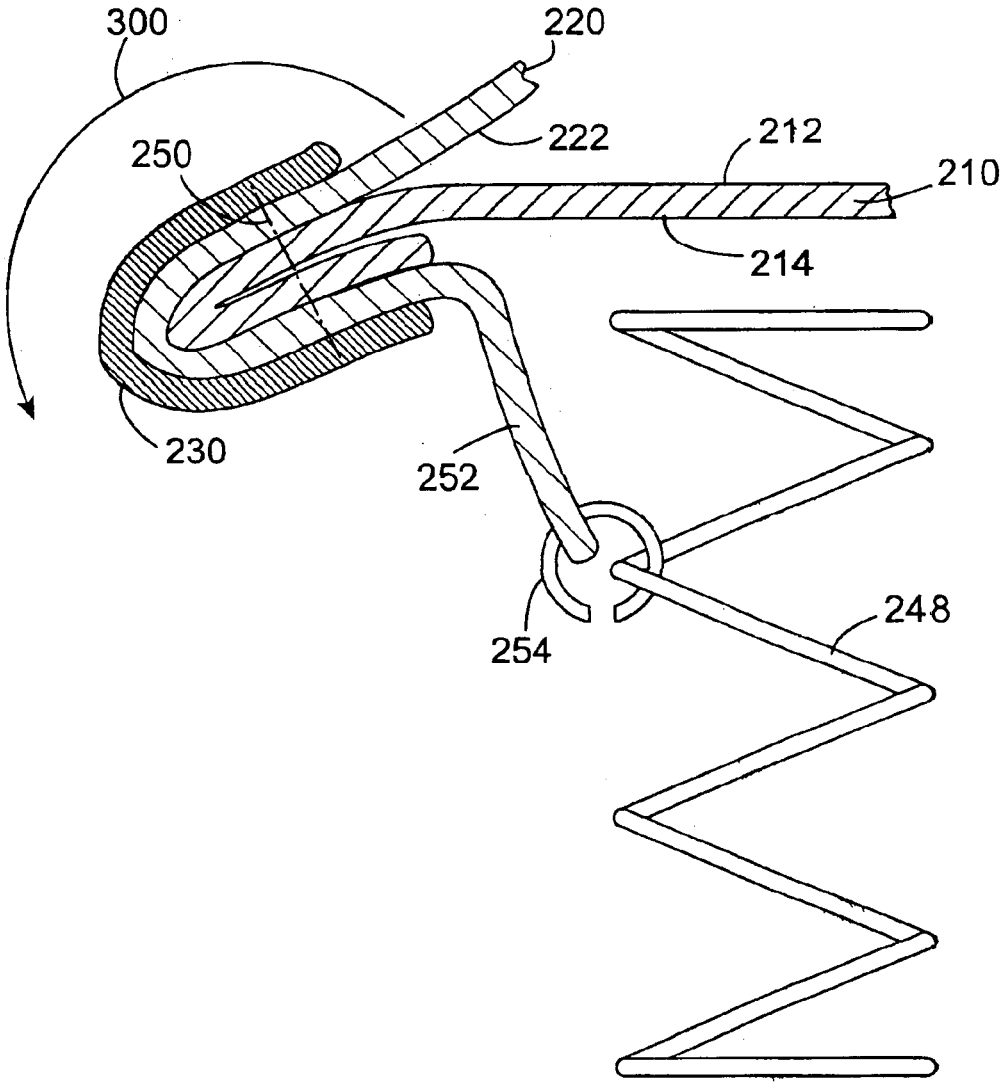
Figure 4D:
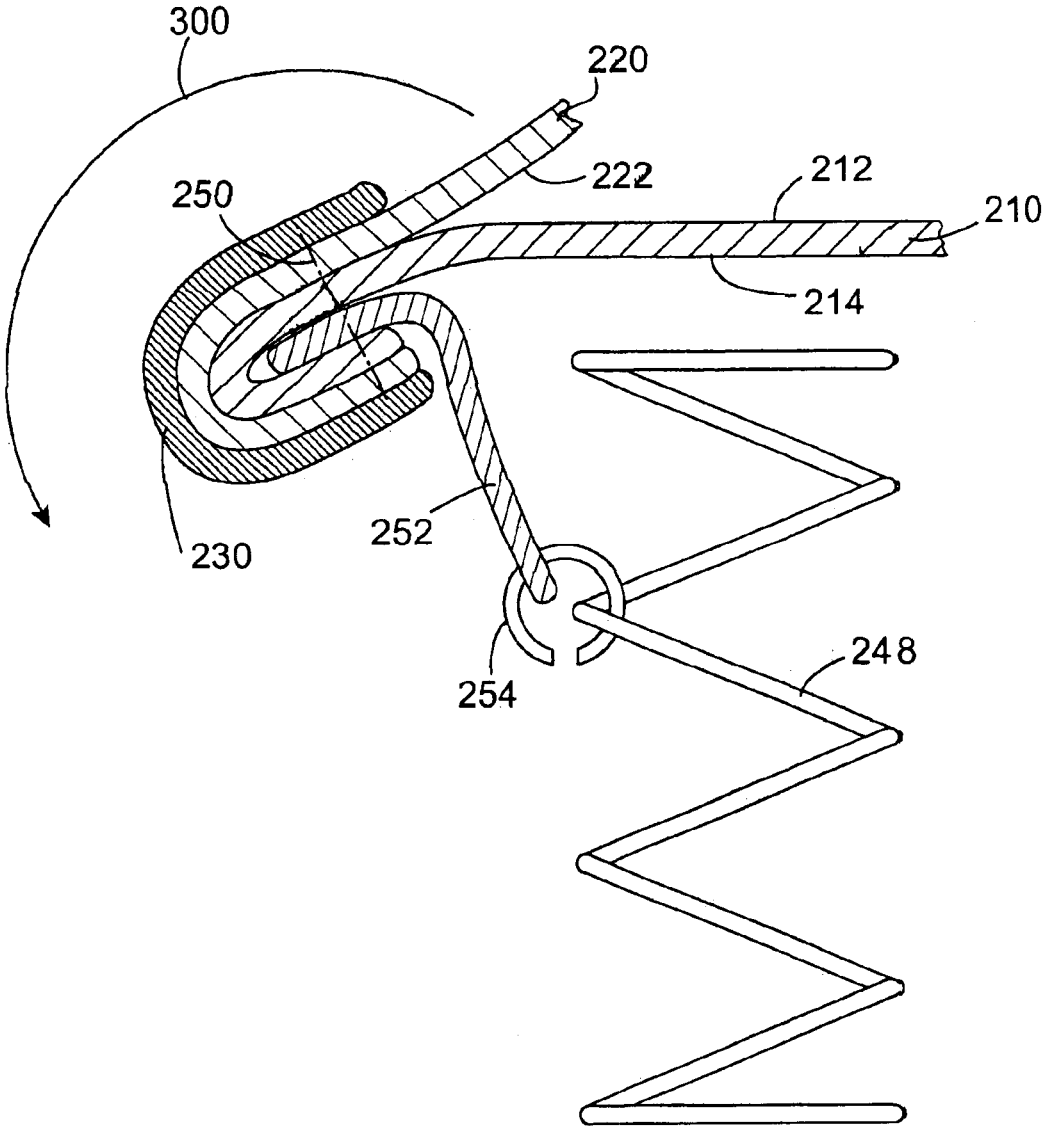

As shown in FIGS. 4B–4D, the inverted seam can be strengthened by folding the panel and border at least once, with the unfinished sides 214 of the panel 210 facing each other at the fold. FIG. 4B shows an arrangement where the flange 252 is integrally formed with the top panel 210; FIG. 4C shows an arrangement where the flange 252 is integrally formed with the border 220; and FIG. 4D shows an arrangement where the flange 252 is formed as a strap separate of the top panel 210 and the border 220. As mentioned before, the welting 230 is optional and can be provided to aid in aligning and strengthening the seam 240.

The seam 240 is then stitched or sewn by conventional means (represented by dashed line 250). This sewing step may include, but is not limited to, flat sewing (i.e., with both the panel 210 and border 220 laid flat on a conventional sewing machine table and fed into a standard flat sewing machine), lacing, or hand-stitching. Other means for permanently attaching panel 210 to border 220, such as stapling, heat fusing, or gluing may also be employed with the inverted seam technique to achieve the salutary effects of the present invention. A conventional tape edge machine can also be used to close the seam.

The mattress is finished by folding down the panel 220 over the side of the mattress, as illustrated in FIGS. 4A–4D by arrow 300. As mentioned above, the bottom seam 260 (FIG. 2) can be closed by a conventional seam closing process, such as the seam 36 shown in the prior art construction of FIG. 1. The stitching and tape of the inverted seam 240 located on the non-finished side are hidden from view after assembly of the mattress. The inverted seam advantageously does not require "perfect" stitching in the top panel closing: restarts, run-offs, chain-offs, spliced or wrinkled tape are acceptable because they will be entirely hidden inside the cover.

As mentioned above, the welting tape 230 may be omitted as a cost- and complexity-reducing measure. In yet another alternate embodiment, a decorative rope welting (216 in FIG. 2), as is conventionally seen on mattresses, may be attached to, or formed on, the outside (finished) surface 222 of border 220. This technique, commonly called self-welting, need not be part of the actual seam 240 and can be added as decorative edge treatment—either before or after forming the inverted seam—without sacrificing the ease of assembly provided by the inverted seam.

As mentioned above, the exemplary inverted seam is advantageously located on the side of the mattress forming the sleeping surface, whereas the bottom panel 230 on the opposite surface not used for sleeping can be attached using a conventional seam, that can be of lesser quality. Such mattresses are typically referred to as one-side mattresses. One-sided mattresses can be placed on or in a foundation. The springs can extend to the corners of the mattress, in which case the corners of the mattress may have to be packed with a soft material to reduce wear of the fabric. Alternatively, the inner coil spring unit can be a least partially encompassed by padding made of, for example, foam rubber, cotton and other materials commonly used in mattress construction, in which case the corner packing can be omitted. In another alternative embodiment, the inner coil spring unit of the mattress could be placed inside a tray having a bottom section and side sections (not shown), with the aforedescribed mattress cover placed over the tray and provided with an inverted seam according to the method of the invention. The tray can be made of a soft material, such as latex or rubber foam.

Figure 1:
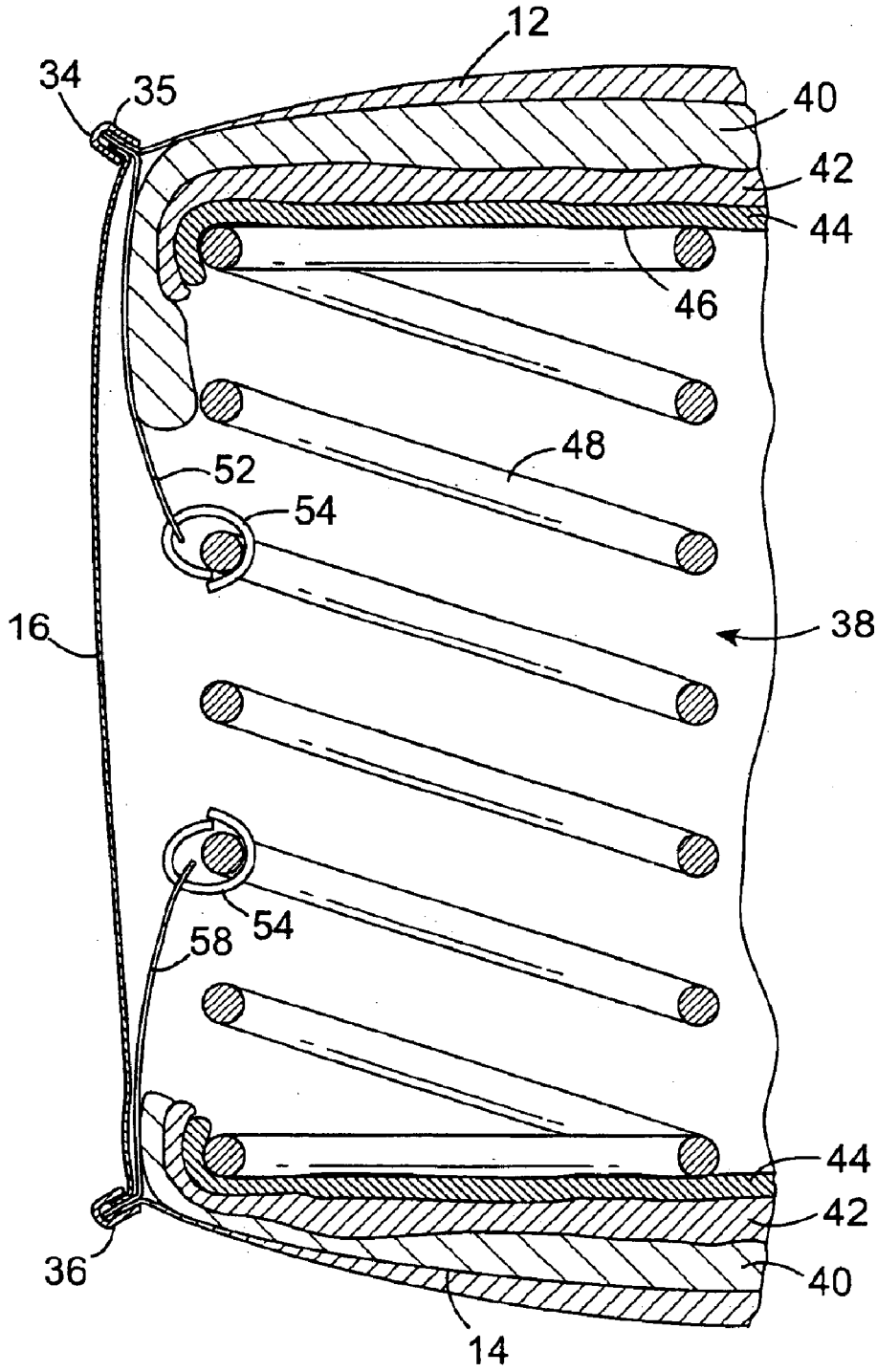
Fig. 1 Prior Art
FIG. 1 is a schematic section of a prior art mattress, illustrating the externally applied border-panel seam.

The bottom panel of one-sided mattresses need not be made of padding and fabric, as in the conventional double-sided mattress depicted in FIG. 1, but can be made, for example, of a material that adds stiffness to the mattress construction, such as a wooden or plastic board, a lattice structure and the like. The free peripheral end of the border can be attached to the bottom panel by conventional stitching, with hog rings, optionally with added support rails, with an adhesive, and other means known in the art. Alternatively or in addition, if two inverted seams are desired on both peripheral end of the border, the mattress cover could be provided with a closeable opening, such as a zipper, whereby the entire cover could be assembled and, for example, stitched remote from the mattress and then slipped over the mattress.

Figure 5:
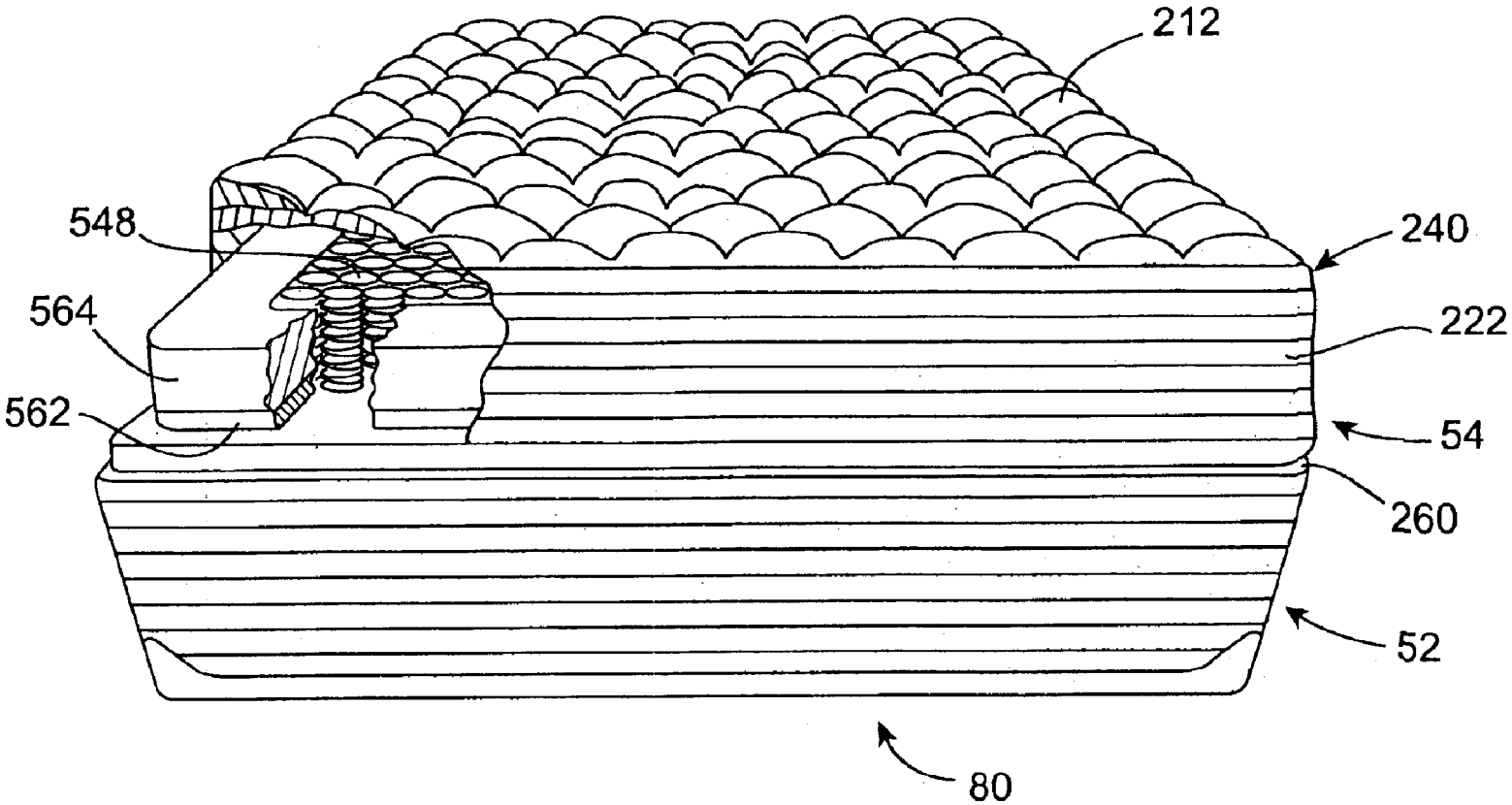
FIG. 5 shows a perspective, partially cut-away view of an exemplary mattress assembly having the cover of FIG. 2.

FIG. 5 shows an exemplary bed having a mattress 54 resting on a boxspring 52. The mattress cover of mattress 54 includes the inverted seam 240 joining the top panel with an exemplary quilted sleeping surface 212 to the side panel. The partially cut-open view also shows the foam tray with side foam panels 564 and bottom foam panel 562, with springs 548 inserted into the foam tray. This arrangements obviates the need for additional padding between the border 220 and the springs 548, as discussed above.

The order in which the steps of the present method are performed is purely illustrative in nature. In fact, the steps can be performed in any order or in parallel, unless otherwise indicated by the present disclosure.

While particular embodiments of the present invention have been shown and described, it will be apparent to those skilled in the art that changes and modifications may be made without departing from this invention in its broader aspect and, therefore, the appended claims are to encompass within their scope all such changes and modifications as fall within the true spirit of this invention.

We claim:

1. A mattress covering having an inverted seam, comprising:

a top panel having a perimeter edge and a finished side; and a border having a perimeter edge and a finished side, wherein said border is attached to said panel, with said finished side of the panel in direct contact with said finished side of the border, along the perimeter edge of at least one of the panel and the border to form the inverted seam, and wherein said inverted seam is sewn flat.

2. The mattress covering of claim 1, wherein said inverted seam is obscured from view from said finished sides of said panel and said border.

3. The mattress covering of claim 1, wherein said inverted seam further includes a tape encompassing said attached border and panel on a side opposite the finished side of the border and panel.

4. The mattress covering of claim 1, further comprising a decorative welting attached to said finished side of said panel and said border proximate to said inverted seam.

5. The mattress covering of claim 1, further comprising a core around which the covering may be placed and having a plurality of springs and the mattress covering includes at least one flange having two ends, with one end attached to the inverted seam and the other end secured to a spring.

6. The mattress covering of claim 5, wherein the mattress core includes a plurality of springs and a tray encompassing the springs.

7. The mattress covering of claim 6, wherein the tray is made of a foam material.

8. The mattress covering of claim 1, further including a bottom panel which is attached to a peripheral end the border.

9. A mattress covering having an inverted seam, comprising:

a top panel having a perimeter edge and a finished side;

a border having a perimeter edge and a finished side; and a decorative welting attached to said finished side of said panel and said border proximate to said inverted seam, wherein said border is attached to said panel, with said finished side of the panel in direct contact with facing said finished side of the border, along the perimeter edge of at least one of the panel and the border to form the inverted seam.

10. A method of forming a mattress covering having an inverted seam, comprising:

arranging a panel on a mattress, said panel having an unfinished side facing the mattress, a finished side opposite the unfinished side and forming a sleeping surface, and a perimeter;

positioning a border having a perimeter, a free perimeter and a finished side in such a way that the perimeter of the border is positioned proximate to the perimeter of the panel and the finished side of the panel faces the finished side of the border; and securing said border to said panel along said perimeter edge of at least one of the panel and the border by at least one of sewing, flat-sewing, gluing, heat-setting and stapling to form the inverted seam, wherein said finished side of the panel is in direct contact with said finished side of the border.

11. The method of claim 10, and further comprising attaching a decorative welting to said finished side of at least one of the panel and the border proximate to said inverted seam.

12. The method of claim 10, further including applying a tape so as to encompass the folded border and panel and sewing along the perimeter edges through the tape, the border and the panel.

13. The method of claim 10, further including applying a tape so as to encompass the border and panel and sewing along the perimeter edges through the tape, the border and the panel.

14. The method of claim 10, further including folding the border over the inverted seam and a side of the mattress, so that the finished side of the border faces outwardly away from the mattress, thereby obscuring the inverted seam from view from said finished sides of said panel and said border.

15. The method of claim 10, further including securing a second panel to the free perimeter edge of the border so as to enclose the mattress between the panel, the second panel and the border.

* * * * *